US008095293B2

(12) United States Patent
Heinkele et al.

(10) Patent No.: US 8,095,293 B2
(45) Date of Patent: Jan. 10, 2012

(54) METHOD AND DEVICE FOR OPERATING AN INTERNAL COMBUSTION ENGINE

(75) Inventors: Matthias Heinkele, Stuttgart (DE); Lutz Reuschenbach, Stuttgart (DE); Michael Drung, Muehlacker (DE); Soenke Mannal, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 12/734,372

(22) PCT Filed: Oct. 30, 2008

(86) PCT No.: PCT/EP2008/064744

§ 371 (c)(1),
(2), (4) Date: Aug. 31, 2010

(87) PCT Pub. No.: WO2009/056604

PCT Pub. Date: May 7, 2009

(65) Prior Publication Data

US 2011/0010076 A1 Jan. 13, 2011

(30) Foreign Application Priority Data

Oct. 30, 2007 (DE) ..... 10 2007 051 873

(51) Int. Cl.
*B60T 7/12* (2006.01)

(52) U.S. Cl. ..... 701/103; 123/684; 73/114.32

(58) Field of Classification Search ..... 701/102, 701/103, 110, 114, 115; 123/444, 403, 679, 123/681, 683, 684; 73/114.32, 114.36
See application file for complete search history.

(56) References Cited

U.S. PATENT DOCUMENTS

| | | | | |
|---|---|---|---|---|
| 5,889,205 | A * | 3/1999 | Treinies et al. | 73/114.32 |
| 5,974,870 | A * | 11/1999 | Treinies et al. | 73/114.33 |
| 6,058,708 | A * | 5/2000 | Heinitz et al. | 60/602 |
| 6,968,689 | B2 * | 11/2005 | Bleile et al. | 60/612 |
| 7,127,347 | B2 * | 10/2006 | Moser et al. | 701/114 |
| 7,246,594 | B2 * | 7/2007 | Hartmann | 123/198 F |
| 7,458,361 | B2 | 12/2008 | Wild | |
| 7,477,980 | B2 * | 1/2009 | Kraemer et al. | 701/102 |
| 2006/0005821 | A1 | 1/2006 | Osumi et al. | |
| 2007/0144493 | A1 | 6/2007 | Wild | |
| 2010/0036580 | A1 * | 2/2010 | Hartmann et al. | 701/102 |
| 2010/0153067 | A1 * | 6/2010 | Heinkele et al. | 702/182 |

FOREIGN PATENT DOCUMENTS

| | | |
|---|---|---|
| DE | 197 50 191 | 3/1999 |
| DE | 10 2005 004 319 | 8/2006 |
| DE | 10 2005 047 446 | 4/2007 |
| DE | 10 20050 059 436 | 6/2007 |
| EP | 1 247 967 | 10/2002 |
| EP | 1 443 199 | 8/2004 |

* cited by examiner

*Primary Examiner* — John Kwon
(74) *Attorney, Agent, or Firm* — Kenyon & Kenyon LLP

(57) ABSTRACT

In a method and a device for operating an internal combustion engine, a first variable characterizing the air-mass flow to the internal combustion engine is determined, and a second variable characterizing the air-mass flow is determined. The second variable characterizing the air-mass flow is used to derive a third variable characterizing the air-mass flow, which is delayed in time with respect to the second variable characterizing the air-mass flow. A difference is formed between the second variable characterizing the air-mass flow and the third variable characterizing the air-mass flow. The first variable characterizing the air-mass flow is corrected by the difference.

10 Claims, 2 Drawing Sheets

METHOD AND DEVICE FOR OPERATING AN INTERNAL COMBUSTION ENGINE

BACKGROUND OF THE INVENTION

1. Field of the Invention

The present invention relates to a method and a device for operating an internal combustion engine using air-mass flow information.

2. Description of Related Art

From published German patent document DE 197 50 191 A1, a method and a device for monitoring the load detection of an internal combustion engine are known in which an air-mass flow signal is measured and an additional air-mass flow signal is calculated on the basis of a throttle-valve position signal. The two signals are adjusted to one another.

BRIEF SUMMARY OF THE INVENTION

In contrast, the method according to the present invention and the device according to the present invention for operating an internal combustion engine have the advantage that the second variable characterizing the air-mass flow is able to be used to determine a third variable characterizing the air-mass flow, the third variable being delayed in time compared to the second variable characterizing the air-mass flow, that a difference is formed between the second variable characterizing the air-mass flow and the third variable characterizing the air-mass flow, and that the first variable characterizing the air-mass flow is corrected by the difference.

In this way the first variable characterizing the air-mass flow is able to be corrected in its dynamic response.

It is particularly advantageous if the first variable characterizing the air-mass flow is measured by an air-mass meter, preferably a hot-wire air-mass meter. In this manner the precision of the signal of the air-mass meter, which is already precise from the steady-state aspect, is able to be improved with regard to dynamic operating states.

It is advantageous if the second variable characterizing the air-mass flow is modeled as air-mass flow via a throttle valve in an air supply to the internal combustion engine, preferably as a function of an opening angle of the throttle valve, a pressure upstream from the throttle valve, a pressure downstream from the throttle valve, and a temperature of the aspirated air upstream from the throttle valve. Thus, it is possible to utilize the detection of the air-mass flow via the throttle valve, which is more precise with regard to the dynamics especially when using the opening angle of the throttle valve, and thus the dynamics of the throttle-valve position, for a dynamically more precise determination of the first variable characterizing the air-mass flow.

It is especially advantageous if the third variable characterizing the air-mass flow is formed by low-pass filtering of the second variable characterizing the air-mass flow. In this way, using the third variable characterizing the air-mass flow, a virtual value for the air-mass flow may be obtained, which is able to be compared with the first variable characterizing the air-mass flow if it is measured with the aid of the air-mass meter featuring the inherent delay. On the basis of the dynamically more precise second variable characterizing the air-mass flow, the low-pass filtering therefore makes it possible to simulate as third variable characterizing the air-mass flow the first variable characterizing the air-mass flow, which variable was determined by the air-mass meter featuring the time delay.

Furthermore, it is advantageous if a time constant of the low-pass filter is formed as quotient of a time constant of the air-mass meter and an elapsed time in order to determine the first and the second value characteristic of the air-mass flow. In this way the time constant of the low-pass filter is able to be adapted to different operating points of the internal combustion engine.

Toward this end, the elapsed time may advantageously be calculated as quotient of twice the reciprocal value of the rotational speed of the internal combustion engine and the number of cylinders.

Moreover, it is advantageous if the first variable characteristic of the air-mass flow is determined as average value of measured values for the air-mass flow during an exhaust phase of a cylinder. This makes it possible to detect the air-mass flow in a precise and reliable manner.

The same applies if the second variable characteristic of the air-mass flow is determined as average value of modeled values for the air-mass flow during a exhaust phase of a cylinder.

DETAILED DESCRIPTION OF THE INVENTION

Figure 1:
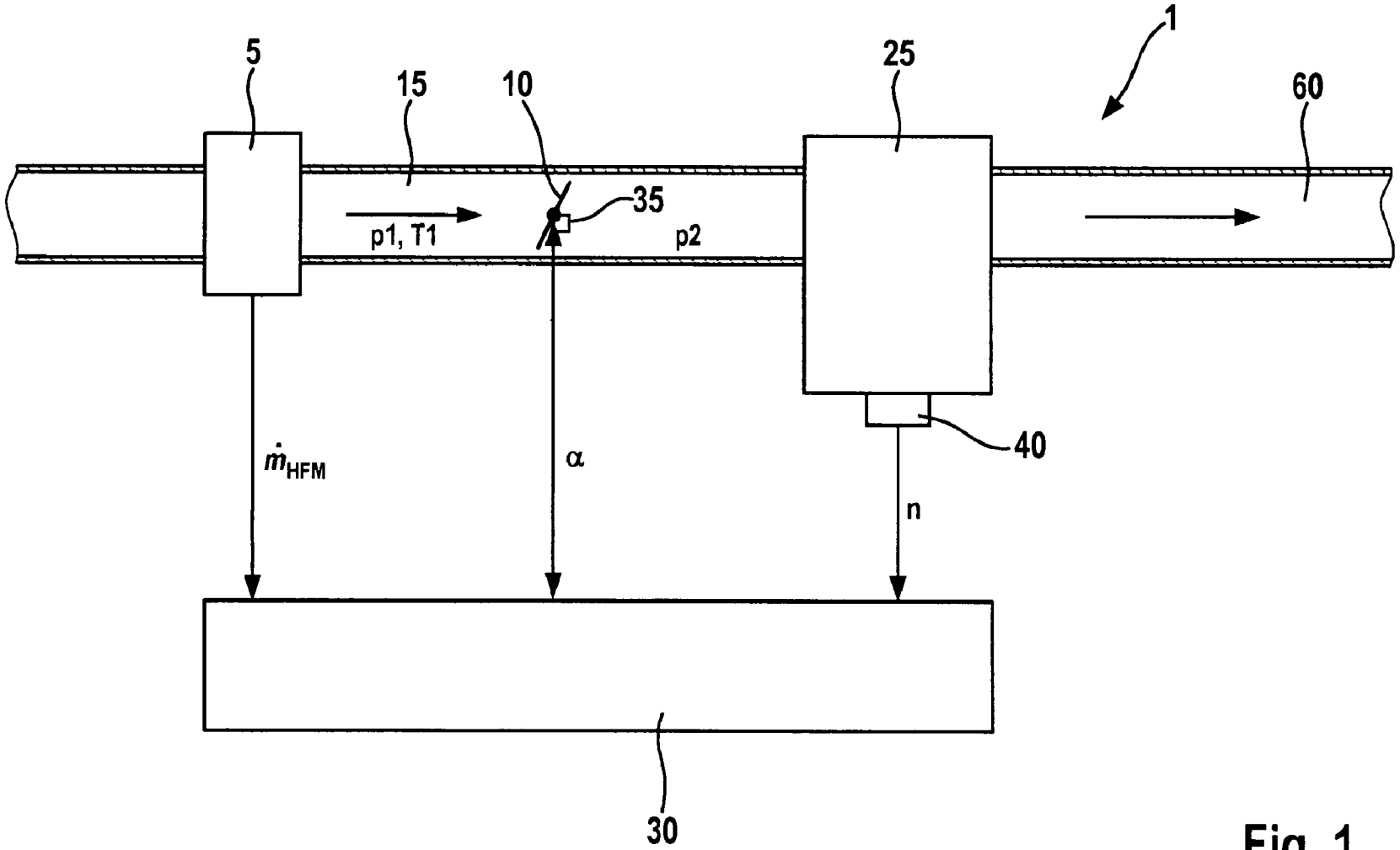
FIG. 1 shows a schematic view of an internal combustion engine.

In FIG. 1, 1 denotes an internal combustion engine which drives a vehicle, for example, and is designed as Diesel engine or as Otto engine, for instance. Internal combustion engine 1 includes one or a plurality of cylinder(s) 25 to which fresh air is supplied via an air supply 15. An arrow in air supply 15 indicates the flow direction of the fresh air. Disposed in air supply 15 is an air-mass meter 5, e.g., a hot-wire air-mass meter, which measures an air-mass flow $\dot{m}_{HFM}$ and forwards the measured values to an engine control 30. In addition, following air-mass meter 5 in the direction of the flow, a throttle valve 10 is situated in air supply 15 whose opening angle is set by engine control 30 as a function of the position of an accelerator pedal (not shown in FIG. 1), for example, and whose opening angle $\alpha$ is detected by a throttle valve position sensor 35 implemented in the form of a potentiometer, for instance. The measured values for throttle valve angle $\alpha$ are likewise forwarded to engine control 30. Situated in the region of cylinder(s) 25 is an rpm sensor 40, which measures engine speed n of internal combustion engine 1 and forwards the measured values to engine control 30. Additional components required for operating internal combustion engine 1, such as fuel injectors or—in the case of Otto engines—spark plugs, as well and intake and discharge valves of cylinder(s) 25, are not shown in FIG. 1 for reasons of clarity. The exhaust gas generated in the combustion of the air/fuel mixture present in the combustion chamber of cylinder(s) 25 is expelled into an exhaust tract 60, the flow direction of the exhaust gas in exhaust tract 60 likewise being indicated by an arrow in FIG. 1.

Figure 2:
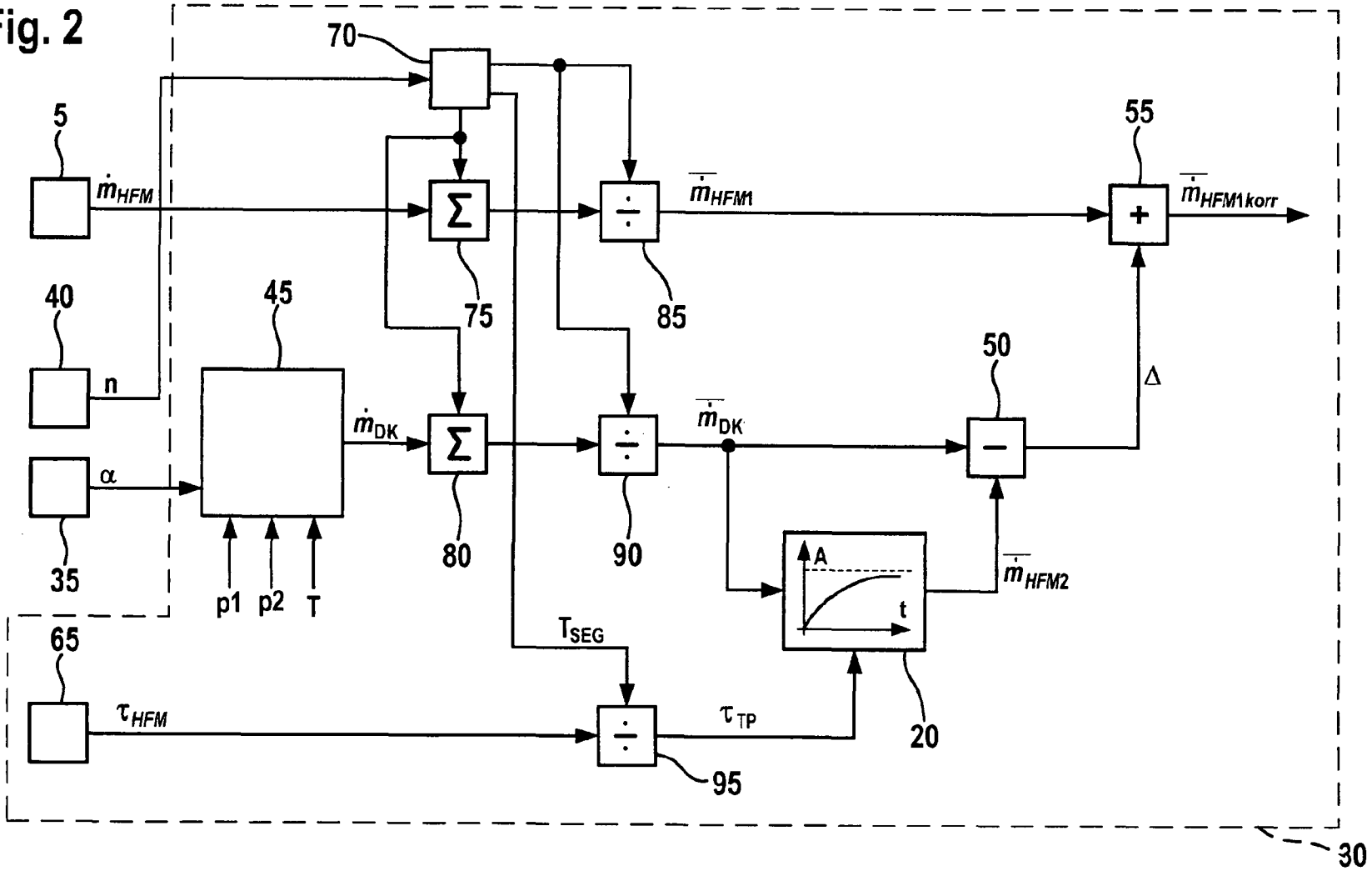
FIG. 2 shows a flow chart for explaining the method according to the present invention and the device according to the present invention.

FIG. 2 shows a flow chart, which is implemented in engine control 30 in the form of hardware or software, for example.

Measured values $\dot{m}_{HFM}$ of air-mass meter 5 are forwarded to a first summing element 75 where they are added up. The produced sum is forwarded to a first division element 85 where it is divided by a number specified by a time control 70. The result of the division represents an average value $\overline{\dot{m}}_{HFM1}$, which corresponds to a first variable characterizing an air-mass flow to internal combustion engine 1 in the form of an arithmetic average value of a plurality of measured values $\dot{m}_{HFM}$ of air-mass meter 5, and is forwarded to an summing element 55.

Rpm sensor 40 forwards the measured values for rotational speed n to a modeling unit 45. The measured values for throttle valve angle α are forwarded to modeling unit 45 by throttle valve position sensor 35. In a manner known to one skilled in the art, modeling unit 45 forms a separate modeled value $\dot{m}_{DK}$ for the air-mass flow through throttle valve 10 as a function of the measured values for throttle-valve angle α received synchronously in time, pressure p1 upstream from throttle valve 10, pressure p2 downstream from throttle valve 10, and temperature T upstream from throttle valve 10. The values for pressure p1, pressure p2, and temperature T may be measured by suitable sensors or modeled from other operating variables of internal combustion engine 1 in the manner known to one skilled in the art. These modeled values for air-mass flow $\dot{m}_{DK}$ through throttle valve 10 are summed up in a second summing element 80. In a second division element 90, the generated sum is divided by the number previously described and supplied by time control 70, so that arithmetic average value $\overline{\dot{m}}_{DK}$ of the air-mass flow flowing through throttle valve 10 is applied at the output of second division element 90 as second variable characteristic of the air-mass flow to internal combustion engine 1. Arithmetic average value $\overline{\dot{m}}_{DK}$ for the air-mass flow through throttle valve 10 is forwarded to a subtraction element 50 on the one hand, and to a low-pass filter 20 on the other. The output variable of low-pass filter 20 represents a third variable $\overline{\dot{m}}_{HFM2}$ characteristic of the air-mass flow to internal combustion engine 1 and is likewise forwarded to subtraction element 50. In subtraction element 50 third variable $\overline{\dot{m}}_{HFM2}$ characterizing the air-mass flow to internal combustion engine 1 is subtracted from arithmetic average value $\overline{\dot{m}}_{DK}$ for the air-mass flow through throttle valve 10. In summing element 55, difference formed at the output of subtraction element 50 is added to arithmetic average value $\overline{\dot{m}}_{HFM1}$ of values $\dot{m}_{HFM}$ for the air-mass flow measured by air-mass meter 5, so that a corrected arithmetic average value $\overline{\dot{m}}_{HFM1korr}$ results at the output of summing element 55 for the values of air-mass flow $\dot{m}_{HFM}$ measured by air-mass meter 5. The charge of the combustion chamber of cylinder(s) 25, for example, is then able to be determined from this corrected arithmetic average value $\overline{\dot{m}}_{HFM1korr}$ for the values of air-mass flow $\dot{m}_{HFM}$ measured by air-mass meter 5.

A description of the manner in which time constant τTP of low-pass filter 20 is calculated will follow. For this purpose, a time constant τHFM of air-mass meter 5 is stored in a memory element 65. This value may either be adopted in memory element 65 from the manufacturer of air-mass meter 5, or be determined with the aid of test-stand measurements and stored in memory element 65. It is also possible, for instance, to consider a time constant of the signal conditioning of utilized air-mass meter 5 in addition. Time constant τHFM of air-mass meter 5 indicates the signal delay of air-mass meter 5, i.e., the time that elapses between the presence of an air-mass flow and the output of a corresponding measured value of this air-mass flow by air-mass meter 5. Time constant τHFM is forwarded to a third division element 95, where it is divided by a segment time $T_{SEG}$ which is determined by time control 70 and corresponds to the interval required to determine arithmetic average value $\overline{\dot{m}}_{HFM1}$ and thus also to determine arithmetic average value $\overline{\dot{m}}_{DK}$; in other words, it corresponds to the time during which the number—determined by time control 70—of measured values $\dot{m}_{HFM}$, n, α is ascertained by air-mass meter 5, rpm sensor 40 and throttle valve position sensor 35, respectively, this number being forwarded by the time control to first division element 85 and second division element 90 as described. Segment time $T_{SEG}$ is also determined by time control 70. That is to say, time constant τHFM of air-mass meter 5 is divided by segment time $T_{SEG}$ in third division element 95. Resulting quotient $\tau_{HFM}/T_{SEG}$ is forwarded to low pass 20 as input value τTP for the time constant of low pass 20.

Furthermore, the measured values for rotational speed n are forwarded to time control 70 which, in addition to its previously described functions, synchronously also initializes summing elements 75, 80 by the value of zero, i.e., whenever a segment time $T_{SEG}$ has elapsed.

In the following text the method of functioning of the flow chart according to FIG. 2 will be described in greater detail. Time control 70 calculates segment time $T_{SEG}$, which is defined as follows:

$$T_{SEG} = \frac{2/n}{cylindernumber} \tag{1}$$

The "cylinder number" value corresponds to the number of cylinders of internal combustion engine 1. If, for example, internal combustion engine 1 has four cylinders, then the cylinder number is four. In order to prevent time control 70 from calculating a new segment time $T_{SEG}$ during a segment time $T_{SEG}$, it may be provided that once time control 70 has calculated a segment time $T_{SEG}$ based on a current measured value for rotational speed n, it enables a renewed calculation of segment time $T_{SEG}$ only after the previously calculated segment time $T_{SEG}$ has elapsed. Hand-in-hand with the calculation of segment time $T_{SEG}$, time control 70 starts a timing element (not shown in FIG. 2), which elapses only when the currently calculated segment time $T_{SEG}$ has elapsed. When this timing element is started, time control 70 also initializes each summing element 75, 80 by the zero value. For instance, measured values $\dot{m}_{HFM}$, n, α are determined in a fixed time pattern of 1 ms, for example. Time control 70 therefore calculates the number of measured values $\dot{m}_{HFM}$ of air-mass meter 5 determined during the currently calculated segment time $T_{SEG}$, which number also corresponds to the number of modeled values $\dot{m}_{DK}$ during segment time $T_{SEG}$ due to the synchronous determination of measured values $\dot{m}_{HFM}$, n, α. This number is supplied to division elements 85, 90. When segment time $T_{SEG}$ has elapsed, time control 70 triggers division elements 85, 90 in a manner not shown, for the calculation of arithmetic average values $\overline{\dot{m}}_{HFM1}$, $\overline{\dot{m}}_{DK}$; when segment time $T_{SEG}$ has elapsed, they calculate the quotient of the then available sum of measured values $\dot{m}_{HFM}$ at the output to first summation element 75 for one, also the determined number of measured values for forming arithmetic average value $\overline{\dot{m}}_{HFM1}$, as well as the quotient of the sum of modeled values $\dot{m}_{DK}$ available at the end of segment time $T_{SEG}$, and the number of modeled values $\dot{m}_{DK}$, determined by time control 70, as arithmetic average value $\overline{\dot{m}}_{DK}$. Then, summing elements 75, 80 are reinitiated by the value of zero, a new segment time $T_{SEG}$ is calculated as a function of the then available current rotational speed n, and division elements 85, 90 are blocked until new segment time $T_{SEG}$ has elapsed. In the case of the four-cylinder internal combustion engine described by way of example, the crankshaft sweeps across a crank angle of 180° during segment time $T_{SEG}$. Ideally, the initialization of summing elements 75, 80, and thus the recalculation of segment times $T_{SEG}$, is implemented in a crankshaft-synchronous manner, i.e., the summation by summing elements 75, 80, starting from the value of zero, actually does take place during the intake stroke of precisely one cylinder of internal combustion engine 1. The four-cylinder internal combustion engine is operated in four-stroke operation, for instance. A corresponding synchronization of time control 70 to the intake stroke of precisely one cylinder may be implemented with the aid of the signal from a crankshaft position sensor, for instance, which indicates the precise crankshaft angle position relative to top dead center of cylinder(s) 25 in the manner known to one skilled in the art. The crankshaft position sensor may be identical with rpm sensor 40 and output the instantaneous crank angle for one and current rotational speed n as temporal gradient thereof to engine control 30 for another.

In the example according to FIG. 2, low pass 20 has the following transmission function ü

$$\ddot{u}=1-e^{-t/\tau_{TP}} \quad (2).$$

Third variable $\overline{\dot{m}}_{HFM2}$ characterizing the air-mass flow to internal combustion engine 1 thus results as follows for an n-th computational step:

$$\overline{\dot{m}}_{HFM2}(n)=(\overline{\dot{m}}_{DK}(n)-\overline{\dot{m}}_{HFM2}(n-1))*\ddot{u}+\overline{\dot{m}}_{HFM2}(n-1) \quad (3)$$

with $n \geqq 1$ and $\overline{\dot{m}}_{HFM2}(0)=\overline{\dot{m}}_{DK}(0)$.

Low pass 20 thus simulates the delay behavior of air-mass meter 5. Modeled values $\overline{\dot{m}}_{DK}$ for the air-mass flow via throttle valve 10 are determined using the dynamics of throttle valve angle α, that is to say, in a manner that is virtually free of delays. In dynamic operating situations of internal combustion engine arithmetic average value $\overline{\dot{m}}_{DK}$ consequently constitutes a delay-free value that characterizes the air-mass flow to internal combustion engine 1. Due to the low-pass filtering based on time constant τTP characterizing the signal delay of air-mass sensor 5, third variable $\overline{\dot{m}}_{HFM2}$ characterizing the air-mass flow to internal combustion engine 1 represents a virtual mass-flow value of air-mass sensor 5. Because of difference Δ, a dynamically precise correction of arithmetic average value $\overline{\dot{m}}_{HFM1}$ of values $\overline{\dot{m}}_{HFM}$ measured by air-mass meter 5 is therefore achieved at the output of summing element 55 in the form of corrected arithmetic average value $\overline{\dot{m}}_{HFM1korr}$.

Between the initialization of summing elements 75, 80 and the elapsing of the particular segment time $T_{SEG}$, division elements 85, 90 each emit the most recently calculated arithmetic average value $\overline{\dot{m}}_{HFM1}$, $\overline{\dot{m}}_{DK}$ These arithmetic average values are updated only when current segment time $T_{SEG}$ has elapsed. Initially, i.e., upon the startup of internal combustion engine 1, arithmetic average values $\overline{\dot{m}}_{HFM1}$, $\overline{\dot{m}}_{DK}$ are initialized using the value of zero.

The following is provided as numerical example: In case of a four-cylinder/four-stroke internal combustion engine, given an idling speed of n−1,000 rotations per minute, a segment time $T_{SEG}$ of 30 ms results according to equation (1), during which time thirty measured values are recorded in the described scanning raster of air-mass sensor 5, rpm sensor 40 and throttle valve position sensor 35 of 1 ms, so that thirty sequential measuring or modeling values are added up in summing elements 75, 80, and the number determined by time control 70 and forwarded to division elements 85, 90 corresponds to the number 30.

In one advantageous development of the present invention, the modeling of air-mass flow $\overline{\dot{m}}_{DK}$ through throttle valve 10 is able to take into account also the pressure upstream from throttle valve 10 and additionally possibly the intake manifold pressure downstream from throttle valve 10, as this can also be gathered from the printed publication DE 197 50 191 A1. In case of a turbocharged internal combustion engine, it is also possible to consider the charge-air pressure upstream from throttle valve 10 instead of the ambient pressure.

In the first order, time constant $\tau_{HFM}$ of air-mass meter 5 is roughly independent of the operating point of internal combustion engine 1, but it may differ depending on the manufacturer.

The described dynamically precise correction of arithmetic average value $\overline{\dot{m}}_{HFM1}$ of measured values $\dot{m}_{HFM}$ of air-mass meter 5 is advantageous, in particular when using a turbocharger (not shown in FIG. 1), if hand-in-hand with it, the intake manifold volume downstream from throttle valve 10 is set up to be lower, with the result that dynamic errors in the air-flow measurement by air-mass meter 5 would have a more pronounced effect on the charge-air detection, for instance.

Of decisive importance for the described dynamically precise correction of arithmetic average value $\overline{\dot{m}}_{HFM1}$ of measured values $\overline{\dot{m}}_{HFM}$ of air-mass meter 5 is the use of a dynamically correct signal for the air-mass flow, as it is represented, for instance, by arithmetic average value $\overline{\dot{m}}_{DK}$ for the air-mass flow through the throttle valve in the example according to FIG. 2. As an alternative, instead of the air-mass flow through the throttle valve used in the exemplary embodiment according to FIG. 2, any other air-mass flow to internal combustion engine 1 detectable in a dynamically precise manner may be used for the described dynamically precise correction of the air-mass flow measured by air-mass flow meter 5. For example, an air-mass detection via an intake manifold pressure sensor in the manner known to one skilled in the art is also suitable for this purpose.

Taking the pressure upstream and possibly also the pressure downstream from throttle valve 10 into account when determining the air-mass flow through the throttle valve makes it possible to ascertain air-mass flow $\dot{m}_{DK}$ through the throttle valve in a dynamically even more precise manner.

In the example according to FIG. 2, low pass 20 having transmission function ü according to equation (2) is used as low pass of the first order for simulating the signal delay of air-mass meter 5. As an alternative, the signal delay may be modeled in some other manner as well, for example by a low pass having a higher than first order.

Thus, the accuracy of the precise measuring signal of air-mass meter 5 in the steady state is able to be increased with the aid of the described correction in the dynamic operating range of internal combustion engine 1 as well.

What is claimed is:

1. A method for operating an internal combustion engine, comprising:

determining a first variable for an air-mass flow to the internal combustion engine;

determining a second variable for the air-mass flow;

deriving a third variable for the air-mass flow from the second variable for the air-mass flow, wherein the third variable is delayed in time relative to the second variable;

forming a difference between the second variable for the air-mass flow and the third variable for the air-mass flow; and correcting the first variable for the air-mass flow based on the difference.

2. The method as recited in claim 1, wherein the first variable for the air-mass flow is determined by measuring with the aid of an air-mass meter.

3. The method as recited in claim 1, wherein the second variable for the air-mass flow is modeled as air-mass flow through a throttle valve in an air supply to the internal combustion engine.

4. The method as recited in claim 3, wherein the second variable for the air-mass flow is modeled as a function of an opening angle of the throttle valve, a pressure upstream from the throttle valve, a pressure downstream from the throttle valve, and a temperature upstream from the throttle valve.

5. The method as recited in claim 4, wherein the third variable for the air-mass flow is formed by low-pass filtering the second variable for the air-mass flow.

6. The method as recited in claim 1, wherein the first variable for the air-mass flow is determined by measuring with the aid of an air-mass meter, wherein the third variable for the air-mass flow is formed by low-pass filtering the second variable for the air-mass flow, and wherein a time constant of the low-pass filter is formed as quotient of a time constant of the air-mass meter and an elapsed time for determining the first and the second variables for the air-mass flow.

7. The method as recited in claim 6, wherein the elapsed time is calculated as quotient of twice the reciprocal value of the rotational speed of the internal combustion engine and the number of cylinders.

8. The method as recited in claim 6, wherein the first variable for the air-mass flow is determined as average value of measured values for the air-mass flow during an exhaust phase of a cylinder.

9. The method as recited in claim 5, wherein the second variable for the air-mass flow is determined as average value of modeled values for the air-mass flow during an exhaust phase of a cylinder.

10. A control device for operating an internal combustion engine, comprising:

a first determination unit configured to determine a first variable for an air-mass flow to the internal combustion engine;

a second determination unit configured to determine a second variable for the air-mass flow;

a derivation unit configured to derive a third variable for the air-mass flow from the second variable for the air-mass flow, wherein the third variable is delayed in time relative to the second variable for the air-mass flow;

a subtraction unit configured to form a difference between the second variable for the air-mass flow and the third variable for the air-mass flow; and a correction unit configured to correct the first variable for the air mass flow based on the difference.

* * * * *